US010299044B2

(12) United States Patent
Grinnip, III

(10) Patent No.: US 10,299,044 B2
(45) Date of Patent: May 21, 2019

(54) STABILIZER FOR MICROPHONE DIAPHRAGM

(71) Applicant: Shure Acquisition Holdings, Inc., Niles, IL (US)

(72) Inventor: Roger Stephen Grinnip, III, Lake Zurich, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 14/292,110

(22) Filed: May 30, 2014

(65) Prior Publication Data

US 2014/0355814 A1 Dec. 4, 2014

Related U.S. Application Data

(60) Provisional application No. 61/829,010, filed on May 30, 2013.

(51) Int. Cl.
*H04R 9/00* (2006.01)
*H04R 7/20* (2006.01)

(52) U.S. Cl.
CPC ..... *H04R 7/20* (2013.01)

(58) Field of Classification Search
CPC ... H04R 7/16; H04R 1/00; H04R 7/20; H04R 9/043; H04R 7/12; H04R 9/06; H04R 31/003; H04R 7/04
USPC ..... 381/398, 303–305
See application file for complete search history.

(56) References Cited

U.S. PATENT DOCUMENTS

| | | | | |
|---|---|---|---|---|
| 1,897,294 | A | 2/1933 | Marcel | |
| 4,590,332 | A * | 5/1986 | Delbuck | H04R 1/025 381/186 |
| 5,734,132 | A * | 3/1998 | Proni | 181/171 |
| 6,118,884 | A | 9/2000 | Proni | |
| 6,674,871 | B1 * | 1/2004 | Chan | H04R 9/041 381/403 |
| 7,366,318 | B2 * | 4/2008 | Nevill | 381/403 |
| 8,768,000 | B2 | 7/2014 | Chen et al. | |

(Continued)

FOREIGN PATENT DOCUMENTS

| | | |
|---|---|---|
| JP | 51057635 | 5/1976 |
| JP | 2012151821 | 8/2012 |
| WO | 2008008034 | 1/2008 |

OTHER PUBLICATIONS

International Search Report and Written Opinion from International Patent Application No. PCT/US2014/040280, dated Oct. 23, 2014, 9 pages.

*Primary Examiner* — Norman Yu
(74) *Attorney, Agent, or Firm* — William J. Lenz, Esq.; Neal, Gerber & Eisenberg LLP

(57) ABSTRACT

A stabilizer for use in stabilizing a diaphragm of an audio device, such as a microphone transducer or a speaker driver. The stabilizer is configured to be attached to the diaphragm to provide stability to the diaphragm, which may be in the form of one or more of counteraction to asymmetric movement about the center of mass of the voice coil; counteraction to rotation in a direction perpendicular to the desired axial motion of the diaphragm; and additional nonlinear stiffness for mechanical limiting of the diaphragm in the axial direction, which may assist in preventing large excursions of the diaphragm from atypical sources, such as drop, shock, etc.

15 Claims, 2 Drawing Sheets

(56) References Cited

U.S. PATENT DOCUMENTS

| | | | | |
|---|---|---|---|---|
| 2003/0031337 | A1 | 2/2003 | D'Hoogh | |
| 2007/0127765 | A1* | 6/2007 | Chan | 381/396 |
| 2008/0013781 | A1* | 1/2008 | Sagren | H04R 9/043 381/398 |
| 2012/0008815 | A1* | 1/2012 | Humphreys | H04R 9/04 381/400 |
| 2012/0183157 | A1* | 7/2012 | Chen | H04R 7/26 381/120 |

* cited by examiner

FIG. 2A
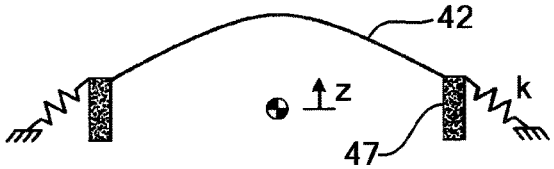
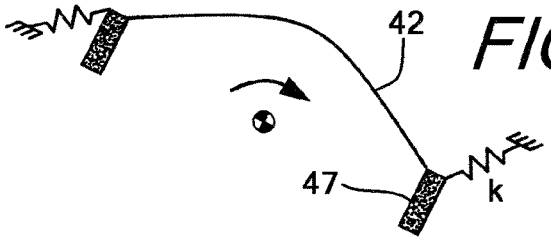
FIG. 2B
FIG. 3
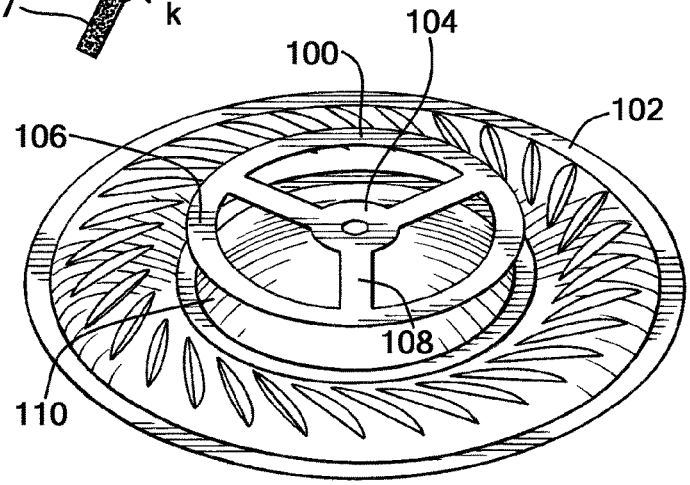
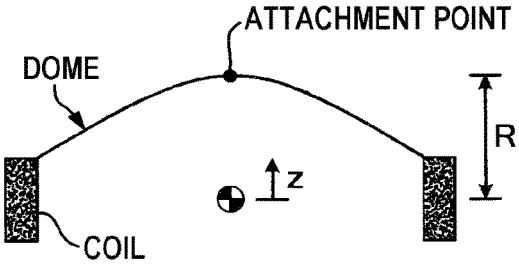
FIG. 4
FIG. 5
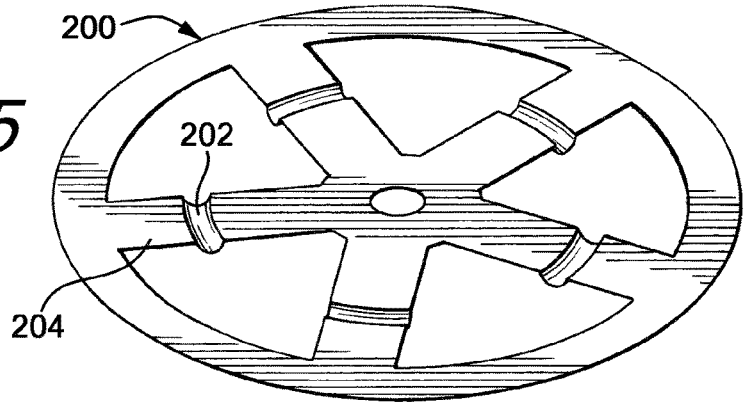

STABILIZER FOR MICROPHONE DIAPHRAGM

CROSS-REFERENCE TO RELATED APPLICATION

This application claims the benefit of U.S. Provisional Patent Application No. 61/829,010, filed on May 30, 2013, the contents of which are fully incorporated herein by reference.

TECHNICAL FIELD

This application generally relates to diaphragms within microphone transducer assemblies. In particular, this application relates to stabilization of a diaphragm within a microphone assembly to control unwanted movement in certain conditions.

BACKGROUND

There are several types of microphones and related transducers, such as for example, dynamic, crystal, condenser/capacitor (externally biased and electret), etc., which can be designed with various polar response patterns (cardioid, supercardioid, omnidirectional, etc.) Microphone transducers typically utilize one or more diaphragms to provide a surface upon which sound waves impinge to cause movement of the diaphragm, which can then be translated into an electric acoustical signal. Depending on diaphragm design and implementation within a transducer assembly, frequency responses vary. In some designs, such as in a condenser microphone transducer, frequency responses can be quite high. This possible because the diaphragms of condenser microphone transducers can typically be made thinner and lighter than those of dynamic models due to the fact that, unlike dynamic models, the diaphragms do not have the mass of a voice coil attached thereto within the acoustical space of the transducer. In dynamic microphone transducers, however, especially in high frequency, high sensitivity applications, the mass of the voice coil significantly influences movement of the diaphragm. In such cases of extreme compliance, undesirable asymmetric movement or large excursions may be imparted on the diaphragm in certain circumstances, such as structural vibrations at certain excitation frequencies or even during shock caused by accidental impact or rough handling of the microphone.

In such extreme compliance applications, there is a need for stabilization of a diaphragm within a transducer to prevent or minimize undesirable movement without compromising performance of the diaphragm under normal use.

SUMMARY

In an embodiment, a stabilizer is provided for use in stabilizing a diaphragm of an audio device, such as a microphone transducer or a speaker driver. The stabilizer comprises an annular peripheral portion defining an outer periphery of the stabilizer, a central portion concentrically disposed within the periphery of the stabilizer, and a plurality of strap portions emanating from the central portion and extending outward to the annular peripheral portion. The stabilizer is configured to be attached to the diaphragm at the central portion of the stabilizer to provide stability to the diaphragm, which may be in the form of one or more of counteraction to asymmetric movement about the center of mass of the voice coil; counteraction to rotation in a direction perpendicular to the desired axial motion of the diaphragm; and additional nonlinear stiffness for mechanical limiting of the diaphragm in the axial direction, which may assist in preventing large excursions of the diaphragm from atypical sources, such as drop, shock, etc.

These and other embodiments, and various permutations and aspects, will become apparent and be more fully understood from the following detailed description and accompanying drawings, which set forth illustrative embodiments that are indicative of the various ways in which the principles of the invention(s) may be employed.

BRIEF DESCRIPTION OF THE DRAWINGS

FIGS. 2A and 2B are schematic models illustrating an axial mode of excitation of the diaphragm and an asymmetric mode of excitation of the diaphragm.

FIG. 3 is a perspective assembly view of an exemplary embodiment of a diaphragm and a stabilizer according to one or more particular aspects described herein.

FIG. 4 is a schematic model illustrating the stabilizer attachment point and resulting moment arm R with respect to the center of mass of the diaphragm/coil assembly.

FIG. 5 is a perspective view of an embodiment of a stabilizer according to one or more particular aspects described herein.

DETAILED DESCRIPTION

Figure 1:
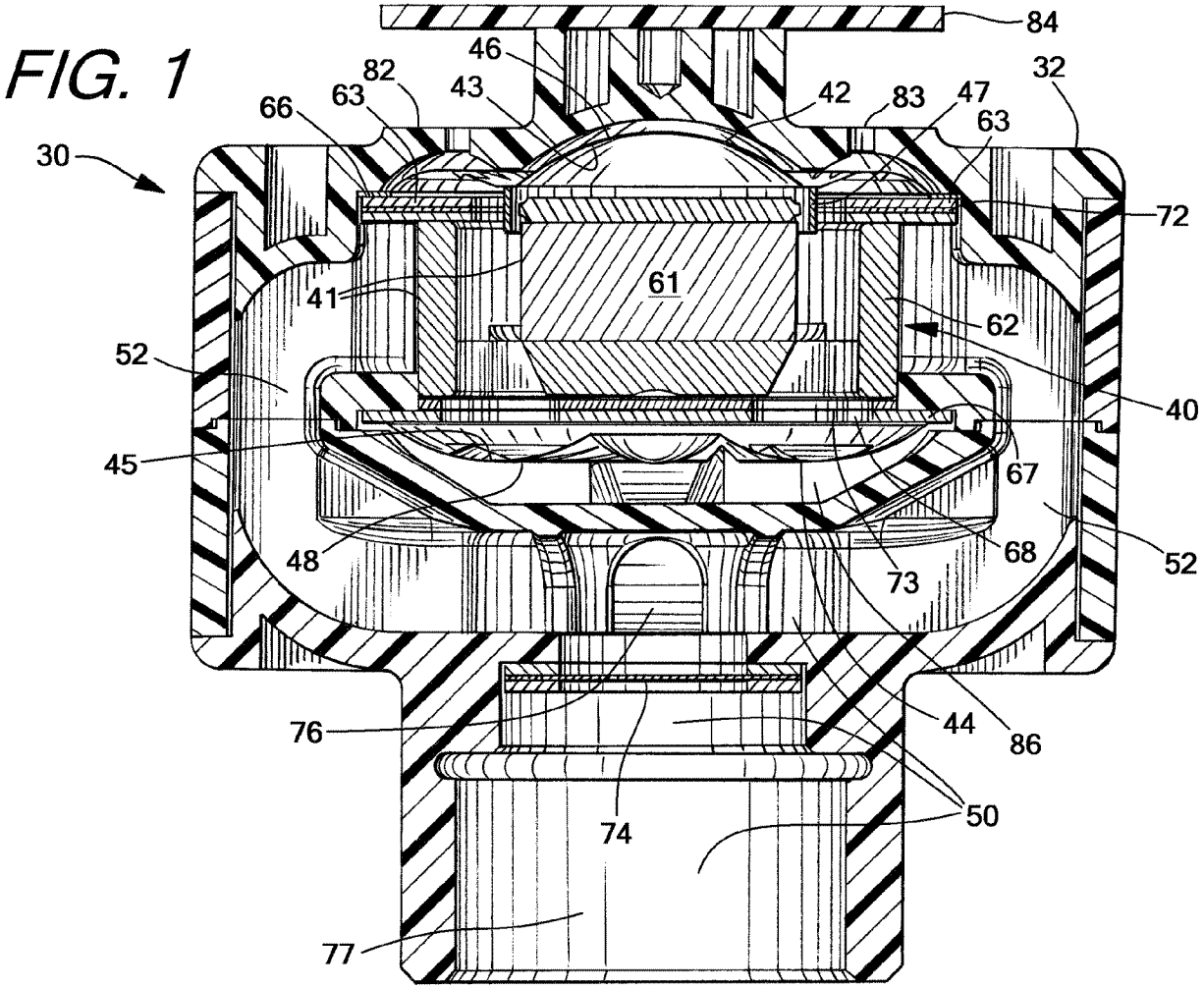
FIG. 1 is an elevational cross-section view of an exemplary dual diaphragm microphone transducer embodiment of the type which may benefit from incorporating one or more principles of the invention(s) described herein.

The description that follows describes, illustrates and exemplifies one or more particular embodiments of the invention(s) in accordance with its principles. This description is not provided to limit the invention(s) to the embodiments described herein, but rather to explain and teach the principles of the invention(s) in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention(s) as taught herein and understood to one of ordinary skill in the art.

By way of background, FIG. 1 is a cross-sectional view of an exemplary dual diaphragm microphone transducer embodiment of the type that may benefit from one or more of the principles of the invention(s) herein. As shown in FIG. 1, a single capsule, dual diaphragm dynamic microphone transducer 30 has a housing 32 and a transducer assembly 40 supported within the housing to accept acoustic waves. As shown in FIG. 1, the transducer assembly 40 comprises a magnet assembly 41, a front diaphragm 42 having a rear surface 43 disposed adjacent the magnet assembly 41, and a rear diaphragm 44 having a rear surface 45 opposingly disposed adjacent the magnet assembly 41 with respect to the rear surface 43 of the front diaphragm 42. A front surface 46 of the front diaphragm 42 is configured to have acoustic waves impinge thereon and the rear surface has a coil 47 connected thereto such that the coil 47 is capable of interacting with a magnetic field of the magnet assembly 41. A front surface 48 of the rear diaphragm 44 is also configured to have acoustic waves impinge thereon. The transducer assembly 40 defines an internal acoustic network space in communication with a cavity 50 within the housing 32 via at least one air passage 52 in the housing 32. In the embodiment shown, four air passages 52 are implemented in the housing 32.

Further by way of background, the magnet assembly 41 of the particular embodiment illustrated includes a centrally disposed magnet 61 having its poles arranged vertically generally along a central vertical axis of the housing 32. An annularly-shaped bottom magnet pole piece 62 is positioned concentrically outwardly from the magnet 61 and has a magnetic pole the same as the magnetic pole of the upper portion of the magnet 61. In this embodiment, a top pole piece 63 is disposed upwardly adjacent to the bottom pole piece and has a magnetic pole opposite that of the upper portion of the magnet 61. In this embodiment, the top pole piece 63 comprises two pieces, but in other embodiments, it may comprise one piece or a number of pieces. As can be seen from FIG. 1, when the front diaphragm 42 has acoustic waves impinge thereon, the coil 47 moves with respect to the magnet assembly 41 and its associated magnetic field to generate electrical signals corresponding to the acoustic waves.

It should be apparent from FIG. 1 that the mass of coil 47 coupled with the compliance of the front diaphragm 42, and other potential factors, such as manufacturing process variables, may cause undesirable movement of the front diaphragm under certain conditions. For example, when large structural vibrations are excited, the front diaphragm 42 and associated coil 47 will be susceptible to substantial asymmetric movement, or "rocking," such as that depicted in FIG. 2B. These excitations may occur both under severe (drop/shock) conditions as well as "rough" handling during use, which may be transmitted through the microphone handle as well as direct contact with the transducer capsule. Although the resulting diaphragm motion depicted in FIG. 2B at small amplitudes produces zero signal output, it becomes problematic when the diaphragm motion is a superposition of both the symmetric (axial) motion of the diaphragm 42 depicted in FIG. 2A and the asymmetric motion of the diaphragm 42 depicted in FIG. 2B.

In accordance with a particular aspect, stabilization of a diaphragm of a microphone transducer or speaker may be achieved by use of a stabilizer, such as the embodiment shown in FIG. 3 as stabilizer 100 associated with a diaphragm 102. The stabilizer 100 comprises a central portion 104 and an outer annular portion 106 having a web or array of individual straps 108 there between, which provide lateral stabilization force for the benefit of the diaphragm 102. In the embodiment shown, three straps are utilized. However any number of straps may be utilized, with preference for a prime number of straps symmetrically distributed to discourage asymmetric movement. The stabilizer 100 may be attached to a dome portion 110 of the diaphragm 102, preferably at a contact point with the central portion 104 of the stabilizer 100. As shown in FIG. 4, this attachment point creates a moment arm R, equal to the axial distance (z-axis) between the center of mass and the contact point at the top of the dome 110. This moment arm R is maximized by attachment to the top of the dome 110. Maximizing moment arm R maximizes counteraction of the rotation about the center of mass of the system. The stabilizer also acts against rotation in a direction perpendicular to the desired axial motion of the diaphragm 102. Furthermore, the stabilizer 100 may be configured to create a nonlinear stiffness for mechanical limiting of the diaphragm 102 in the axial direction as well, which may assist in preventing large excursions of the diaphragm 102 from atypical sources, such as drop, shock, etc. The stabilizer 100 may be mounted to the diaphragm 102 with a pretension force so that it is not loose, which may affect lateral stability and may also cause audio artifacts, such as buzzing or other unwanted noise. This pretension force, however, should be minimized to minimize additional axial stiffness. The stabilizer 100 may also be anchored at one or more points around its periphery within the transducer assembly.

The stabilizer 100 is preferably made out of a thin polymer film material, but other materials with suitable properties for imparting desired stabilization forces may be utilized as known in the art. The stabilizer 100 may be mounted to the diaphragm 102 at the contact point in numerous ways, including, without limitation, adhesive. The thickness of the film material will be dictated by the appropriate design and stability requirements for specific applications.

The ideal theoretical position of the stabilizer 100 with respect to the diaphragm 102 is in the same plane as the diaphragm dome 110. This provides the ideal transverse stiffness (radial stiffness). Since this is not necessarily achievable due to tolerance stacks and other part and assembly variables causing additional axial stiffness, it has been found that slightly compromising the transverse stiffness accommodates for height variations due to such tolerances. Such compromise can be achieved through certain compliance features formed in the stabilizer 100, such as in-plane features that allow for extension of the straps 108 (e.g., cuts, webbing, spiral patterns, etc.) or features molded into the stabilizer 100. The transverse stiffness and any additional axial stiffness can be balanced appropriately through these features.

FIG. 5 illustrates another embodiment of a stabilizer 200 for use with a diaphragm, where the reduction in transverse stiffness is accomplished through indentations 202 in each strap 204. In this particular embodiment, there are five straps 204; however, any number may be utilized depending on the design parameters. The material of the stabilizer 200 is preferably PET film, which in many cases matches the base substrate diaphragm material utilized in microphone transducers. Based on use of identical material, both the diaphragm and the stabilizer experience the same temperature history in the molding process, and therefore environmental stability is not compromised.

As apparent from the disclosure herein, the stabilizer and associated systems and methods provide stability to a diaphragm of an audio device, such as a microphone transducer or speaker driver. Based on the teachings herein, the stabilizer can be configured and design balanced to provide, among other things, one or more of counteraction to asymmetric movement about the center of mass of the coil; counteraction to rotation in a direction perpendicular to the desired axial motion of the diaphragm; and additional nonlinear stiffness for mechanical limiting of the diaphragm in the axial direction, which may assist in preventing large excursions of the diaphragm from atypical sources, such as drop, shock, etc.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. A stabilizer for use in stabilizing a diaphragm of a microphone transducer, the stabilizer comprising:

an annular peripheral portion being an outer periphery of the stabilizer;

a central portion concentrically disposed within the periphery of the stabilizer; and a plurality of strap portions emanating from the central portion and extending outward to the annular peripheral portion;

wherein the stabilizer is configured to be attached to an apex of a domed portion of a front surface of the diaphragm at the central portion of the stabilizer without support on a rear surface of the diaphragm, wherein the front surface is configured to have acoustic waves impinge thereon, and wherein the stabilizer is configured to counteract rotation of the diaphragm in a direction perpendicular to an axial motion of the diaphragm.

2. The stabilizer of claim 1, further comprising at least one compliance feature formed within each of the strap portions.

3. The stabilizer of claim 2, wherein the at least one compliance feature comprises an indentation.

4. The stabilizer of claim 1, wherein the stabilizer is composed of a polymer material.

5. The stabilizer of claim 1, wherein the stabilizer is configured to be attached at the annular peripheral portion of the stabilizer to a transducer assembly containing the diaphragm.

6. A stabilizer for use in stabilizing a diaphragm of a microphone transducer, the stabilizer comprising:

an annular peripheral portion being an outer periphery of the stabilizer;

a central portion concentrically disposed within the periphery of the stabilizer; and a plurality of strap portions emanating from the central portion and extending outward to the annular peripheral portion;

wherein the stabilizer is configured to be attached at the central portion of the stabilizer to an apex of a domed portion of a front surface of the diaphragm without support on a rear surface of the diaphragm, wherein the front surface opposite of the rear surface, the rear surface having a coil connected thereto, and wherein the stabilizer is configured to counteract asymmetric movement of the diaphragm about a center of mass of the coil.

7. The stabilizer of claim 6, further comprising at least one compliance feature formed within each of the strap portions.

8. The stabilizer of claim 7, wherein the at least one compliance feature comprises an indentation.

9. The stabilizer of claim 6, wherein the stabilizer is composed of a polymer material.

10. The stabilizer of claim 6, wherein the stabilizer is configured to be attached at the annular peripheral portion of the stabilizer to a transducer assembly containing the diaphragm.

11. A transducer assembly for a microphone transducer, comprising:

a magnet assembly;

a diaphragm disposed adjacent the magnet assembly and having a coil connected thereto such that the coil is capable of interacting with a magnetic field of the magnet assembly; and a stabilizer attached to an apex of a domed portion of a front surface of the diaphragm at a central portion of the stabilizer without support on a rear surface of the diaphragm, wherein the front surface is configured to have acoustic waves impinge thereon, and wherein the stabilizer imparts a nonlinear stiffness for mechanical limiting of the diaphragm in an axial direction, the stabilizer comprising:

an annular peripheral portion being an outer periphery of the stabilizer;

the central portion concentrically disposed within the periphery of the stabilizer; and a plurality of strap portions emanating from the central portion and extending outward to the annular peripheral portion.

12. The transducer assembly of claim 11, wherein the stabilizer further comprises at least one compliance feature formed within each of the strap portions.

13. The transducer assembly of claim 12, wherein the at least one compliance feature comprises an indentation.

14. The transducer assembly of claim 11, wherein the stabilizer is composed of a polymer material.

15. The transducer assembly of claim 11, wherein the coil is connected to the rear surface of the diaphragm.

* * * * *